US010337520B2

(12) United States Patent
Alfes

(10) Patent No.: US 10,337,520 B2
(45) Date of Patent: Jul. 2, 2019

(54) FLUID ENERGY MACHINE HAVING A TANDEM DRY GAS SEAL

(71) Applicant: Siemens Aktiengesellschaft, Munich (DE)

(72) Inventor: Ludger Alfes, Dorsten (DE)

(73) Assignee: Siemens Aktiengesellschaft, Munich (DE)

( * ) Notice: Subject to any disclaimer, the term of this patent is extended or adjusted under 35 U.S.C. 154(b) by 367 days.

(21) Appl. No.: 15/314,592

(22) PCT Filed: Jun. 16, 2015

(86) PCT No.: PCT/EP2015/063399
§ 371 (c)(1),
(2) Date: Nov. 29, 2016

(87) PCT Pub. No.: WO2015/193269
PCT Pub. Date: Dec. 23, 2015

(65) Prior Publication Data

US 2017/0191486 A1 Jul. 6, 2017

(30) Foreign Application Priority Data

Jun. 18, 2014 (DE) ..... 10 2014 211 690

(51) Int. Cl.
*F04D 29/10* (2006.01)
*F04D 27/00* (2006.01)
(Continued)

(52) U.S. Cl.
CPC ..... *F04D 29/104* (2013.01); *F01D 11/06* (2013.01); *F04D 17/10* (2013.01); *F04D 27/002* (2013.01);
(Continued)

(58) Field of Classification Search
CPC ..... F04D 29/04; F04D 17/10; F04D 27/002; F04D 29/284; F04D 29/053;
(Continued)

(56) References Cited

U.S. PATENT DOCUMENTS

2012/0093643 A1 4/2012 Alfes

FOREIGN PATENT DOCUMENTS

DE 4216006 C1 4/1993
EP 1008759 A1 6/2000
(Continued)

OTHER PUBLICATIONS

DE Search Report dated Mar. 30, 2016, for DE patent application No. 102014211690.2.
(Continued)

*Primary Examiner* — Jacob M Amick
(74) *Attorney, Agent, or Firm* — Beusse Wolter Sanks & Maire

(57) ABSTRACT

A fluid energy machine having a rotor, with a casing that separates an interior from an exterior, having at least one shaft seal for sealing a gap between the rotor and casing. The shaft seal is a tandem dry gas seal, having an inner and outer seal. The outer seal has a first sealing gas feed, which opens into the gap axially between the outer and inner seal. The shaft seal has a primary discharge between the inner and outer seal, which extracts primary discharge fluid from the gap. The first sealing gas feed has a first control member for controlling the flow rate of the sealing gas. The primary discharge has a second control member for controlling the flow rate of a primary discharge fluid. The first and second control members are matched such that the first pressure is adjusted to a first pressure setpoint.

20 Claims, 2 Drawing Sheets

(51) Int. Cl.

| | |
|---|---|
| ***F01D 11/06*** | (2006.01) |
| ***F04D 29/12*** | (2006.01) |
| ***F04D 17/10*** | (2006.01) |
| ***F04D 29/053*** | (2006.01) |
| ***F04D 29/28*** | (2006.01) |
| ***F04D 29/42*** | (2006.01) |

(52) U.S. Cl.
CPC ..... *F04D 29/053* (2013.01); *F04D 29/124* (2013.01); *F04D 29/284* (2013.01); *F04D 29/4206* (2013.01); *F05D 2270/301* (2013.01)

(58) Field of Classification Search
CPC .... F04D 29/4206; F04D 29/102; F04D 29/10; F04D 29/12; F04D 29/124; F01D 11/06
See application file for complete search history.

(56) References Cited

FOREIGN PATENT DOCUMENTS

| | | | | |
|---|---|---|---|---|
| EP | 1326037 | A1 | 7/2003 | |
| RU | 2232921 | C2 | 7/2004 | |
| WO | 2010118977 | A1 | 10/2010 | |
| WO | 2011061142 | A1 | 5/2011 | |
| WO | 2013083437 | A1 | 6/2013 | |
| WO | WO-2013083437 | A1 * | 6/2013 | ..... F04D 29/124 |

OTHER PUBLICATIONS

International Search Report dated Sep. 10, 2015, for PCT application No. PCT/EP2015/063399.

* cited by examiner

FLUID ENERGY MACHINE HAVING A TANDEM DRY GAS SEAL

CROSS REFERENCE TO RELATED APPLICATIONS

This application is the U.S. National Stage of International Application No. PCT/EP2015/063399 filed Jun. 16, 2015, and claims the benefit thereof. The International Application claims the benefit of German Application No. DE 102014211690.2 filed Jun. 18, 2014. All of the applications are incorporated by reference herein in their entirety.

FIELD OF INVENTION

The invention relates to a fluid energy machine, in particular a turbocompressor, comprising a rotor extending along an axis, comprising a casing, wherein the casing separates an interior from an exterior, comprising at least one shaft seal for sealing a gap between the rotor and the casing, wherein the shaft seal is designed as a tandem dry gas seal, wherein the tandem dry gas seal comprises an inner seal and an outer seal, wherein the outer seal has a first sealing gas feed, which opens into the gap axially between the outer seal and the inner seal, wherein the shaft seal has a primary discharge between the inner seal and the outer seal, which extracts primary discharge fluid from the gap.

BACKGROUND OF INVENTION

Fluid energy machines, in particular turbocompressors, are often sealed at the shaft ends of a rotor by dry gas seals of tandem design (tandem dry gas seals) in order to prevent process gas that is to be compressed from escaping into the environment via the shaft gaps. These dry gas seals must be supplied with dry and filtered sealing gas in order to avoid contaminants and moisture, which prejudice the functioning of the seal. For reliable and stable operation, a pressure is required in the interspace between the inner seal and the outer seal, and this must also be monitored. Only if a pressure gradient is established in this way in the outer gas seal is monitoring of functioning on the outer gas seal possible. More particularly, this pressure gradient across the outer gas seal is also required in order to avoid overheating and instabilities in the gas film between a slip ring and a rotating ring of this seal.

Corresponding arrangements having dry gas seals on fluid energy machines, in particular turbocompressors, are already known from documents WO 2010/034601 A1, WO 2010/034605 A1, WO 2010/102940 A1, WO 2010/118977 A1 and WO 2014/037149 A1. In particular, WO 2010/034601 A1 has already disclosed the problem of monitoring the outer dry gas seal because a low pressure gradient across the outer dry gas seal may occur owing to the low leakage, especially in operating states that do not correspond to full load. In this context, the leakage of the inner dry gas seal is sometimes so low that the pressure in the interspace between the inner dry gas seal and the outer dry gas seal drops. Another problem is the lack of a supply of a cooling fluid to the outer dry gas seal, in particular a process fluid exerting pressure from the inside of the outer dry gas seal or a mixture with the process fluid, ensuring the lubrication and cooling of this seal. To counteract this problem, it is possible to feed relatively large quantities of sealing fluid into the interspace or into the seal itself, thus ensuring cooling and lubrication. However, this has the additional disadvantage that a relatively large quantity of sealing fluid is required, the preparation and provision of which is very expensive and may even prejudice the efficiency of the machine.

SUMMARY OF INVENTION

Starting from the problem and disadvantages of the prior art, the invention has set itself an object of ensuring that the functioning particularly of the outer seal of the tandem arrangement is more reliable and can be monitored better without increasing the requirement for cooling and lubricating sealing fluids.

To achieve this object, a fluid energy machine of the type defined at the outset is proposed, having the additional features of the independent claim. In addition, a method for operating a fluid energy machine of this kind, in accordance with the independent method claim, is proposed. The respective dependent claims that refer back to these contain advantageous developments of the invention. The invention also comprises embodiments which result from combining the dependent claims but are not the product of explicit dependency references, insofar as these combinations are technically possible.

The primary discharge described leads to a disposal system. In most cases, this is a flare system and has a slight excess pressure relative to the environment.

Geometrical indications, such as "axial", "radial", "tangential" and the like relate to the rotor axis defined in the independent claim, unless some other definition is introduced in the particular context.

The terms "inner" and "outer" relate to the "interior" and "exterior", introduced in the independent claim, of the fluid energy machine and of the casing of the fluid energy machine. For the sake of linguistic convenience, these attributes are also used here in such a way that, in relationship to one another, one component is referred to as an inner component if it is situated further in than the other component set in relation thereto, which is arranged relatively further out.

The inner seal and the outer seal of the tandem dry gas seal are each dry gas seals for sealing the gap between the rotor and the casing.

Dry gas seals are contact-free, dry-running sealing ring pairs, which each have a sealing end face, wherein one sealing ring rotates and the other sealing ring is stationary. During operation, recesses in at least one of the two end faces produce a dynamic force, which leads to a gap between the two rings. The use of "dry gas seals", especially in centrifugal compressors, has been increasingly frequent in recent times because leakage and hence contamination of the surrounding components are extremely low and no lubricating oil is required for the use of these seals.

One decisive advantage of the invention consists in the fact that the buffering according to the invention of the primary discharge by means of the second control member ensures the differential pressure across the outer seal without requiring additional sealing gas. In this way, sealing gas consumption is greatly reduced while reliable monitoring and functioning of the outer seal is nevertheless ensured. At the same time, the invention allows reliable operation of the fluid energy machine, even when the primary discharge is completely closed and there is a pressure drop below a first setpoint between the outer seal and the inner seal, with the result that an even smaller pressure drop is observed across the outer seal, since, in coordination with the position of the first control member, a second control member initiates or increases the feeding of additional sealing gas by means of the first sealing gas feed. If there is a fault in the outer seal and sealing gas consumption increases or if there is a drop in the first pressure between the inner seal and the outer seal, an alarm is first of all provided and, if there is a further drop, the fluid energy machine may be switched off, ensuring that neither the outer seal nor the fluid energy machine itself or surrounding components are put at risk.

An advantageous development of the invention envisages that toward the interior, a first labyrinth seal for sealing the gap is assigned to and adjacent to the outer seal. The first labyrinth seal ensures that the sealing gas fed in serves primarily for lubricating and cooling the outer seal and does not readily flow away in the direction of the inner seal.

Another advantageous development of the invention envisages that the primary discharge opens into the gap axially between the first labyrinth seal and the inner seal.

In particular, in combination with the opening of the first sealing gas feed on the outer side of the first labyrinth seal, there is a pressure difference between the sealing gas feed and the primary discharge owing to the first labyrinth seal, and this pressure difference serves for the lubrication and cooling of the outer seal while simultaneously ensuring minimized sealing gas consumption.

As an indication of the approach to a critical state, another advantageous development of the invention envisages that the control unit issues an alarm if the first pressure falls below a pressure alarm threshold. This enables the operating personnel to register approaches to a critical operating state and, if required, to take precautionary countermeasures during operation to avoid shutting down the machine.

Another advantageous development of the invention envisages that the control unit brings about shutdown of the fluid energy machine if the first pressure falls below a second pressure threshold and hence operation without damage, especially to the outer seal, is no longer assured. To protect the inner seal from any aggressive process gas or foreign bodies, it is expedient, according to another advantageous development of the invention, if, toward the interior, a second labyrinth seal for sealing the gap is assigned to and adjacent to the inner seal.

The second labyrinth seal is particularly expedient if, according to an independent development of the invention, the inner seal is assigned a second sealing gas feed, which opens into the gap axially toward the interior, adjacent to the inner seal, in particular between the inner seal and the second labyrinth seal.

Another advantageous development envisages that the second sealing gas feed is connected to the first sealing gas feed in such a way that changing the open position of the first control member also changes a second pressure in the second sealing gas feed. This is appropriate especially if lowering the first pressure in the first sealing gas feed by means of the first control member also results in lowering the second pressure in the second sealing gas feed. It is expedient here if the first sealing gas feed is connected directly to a sealing gas supply, with the first control member arranged in between, with the result that the first pressure in the first sealing gas feed is controlled by means of the control unit. In respect of the sealing gas flow downstream of the first control member, it is expedient if the second sealing gas feed is connected to the line of the first sealing gas feed. Between the points of entry of the sealing gas of the first sealing gas feed and the second sealing gas feed, it is expedient in each case to provide a restrictor element, which ensures a corresponding pressure gradation between the first pressure and the second pressure in the gap, thus ensuring that the inner seal and the outer seal each have the pressure differences required for reliable operation of the seals.

BRIEF DESCRIPTION OF THE DRAWINGS

The invention is explained in greater detail below by means of a specific illustrative embodiment with reference to drawings, in which.

DETAILED DESCRIPTION OF INVENTION

Figure 1:
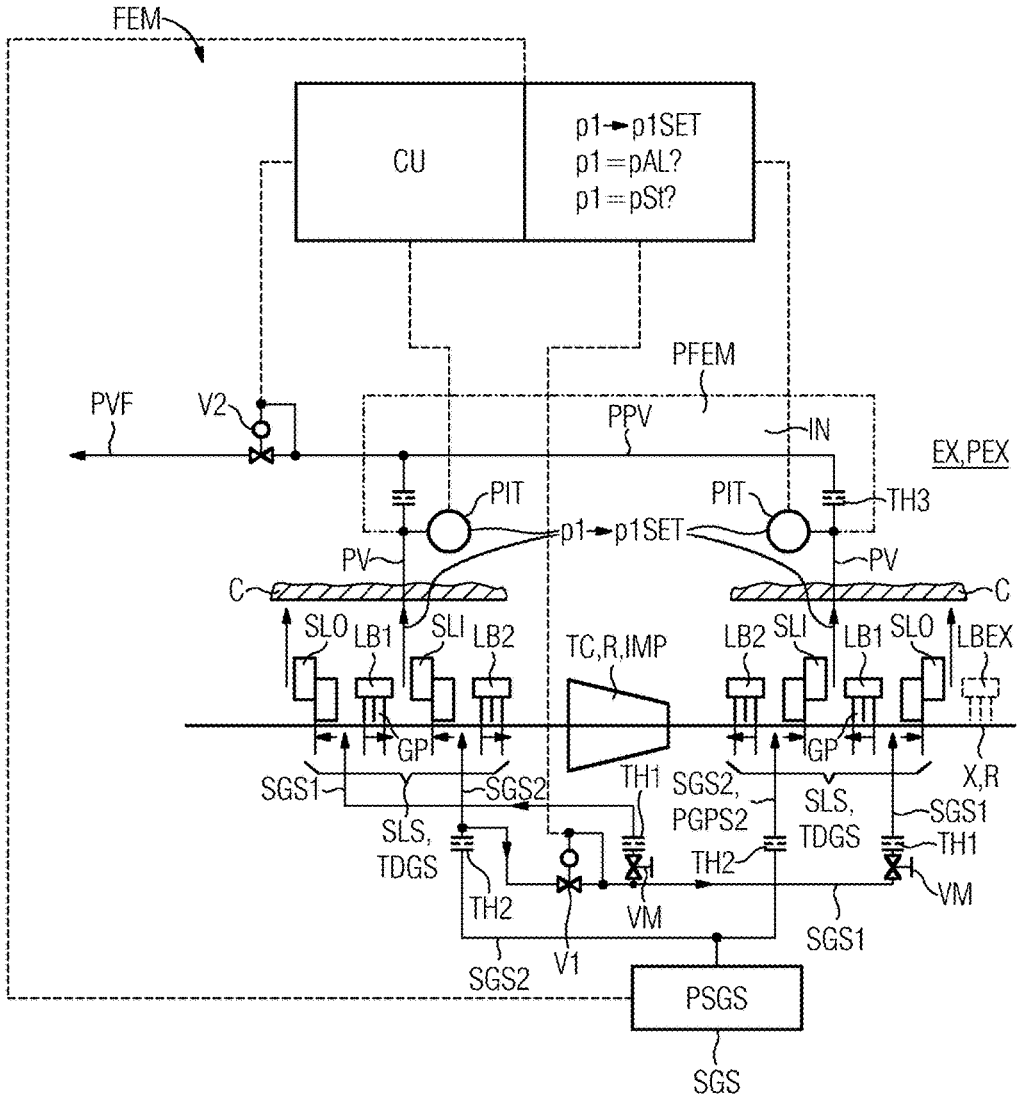
FIG. 1 shows a schematic illustration of the arrangement and functioning of the fluid energy machine according to the invention and of the method according to the invention.

FIG. 1 shows a schematic illustration of the mode of operation of a fluid energy machine FEM according to the invention and of a method according to the invention for the operation of this fluid energy machine FEM.

Figure 2:
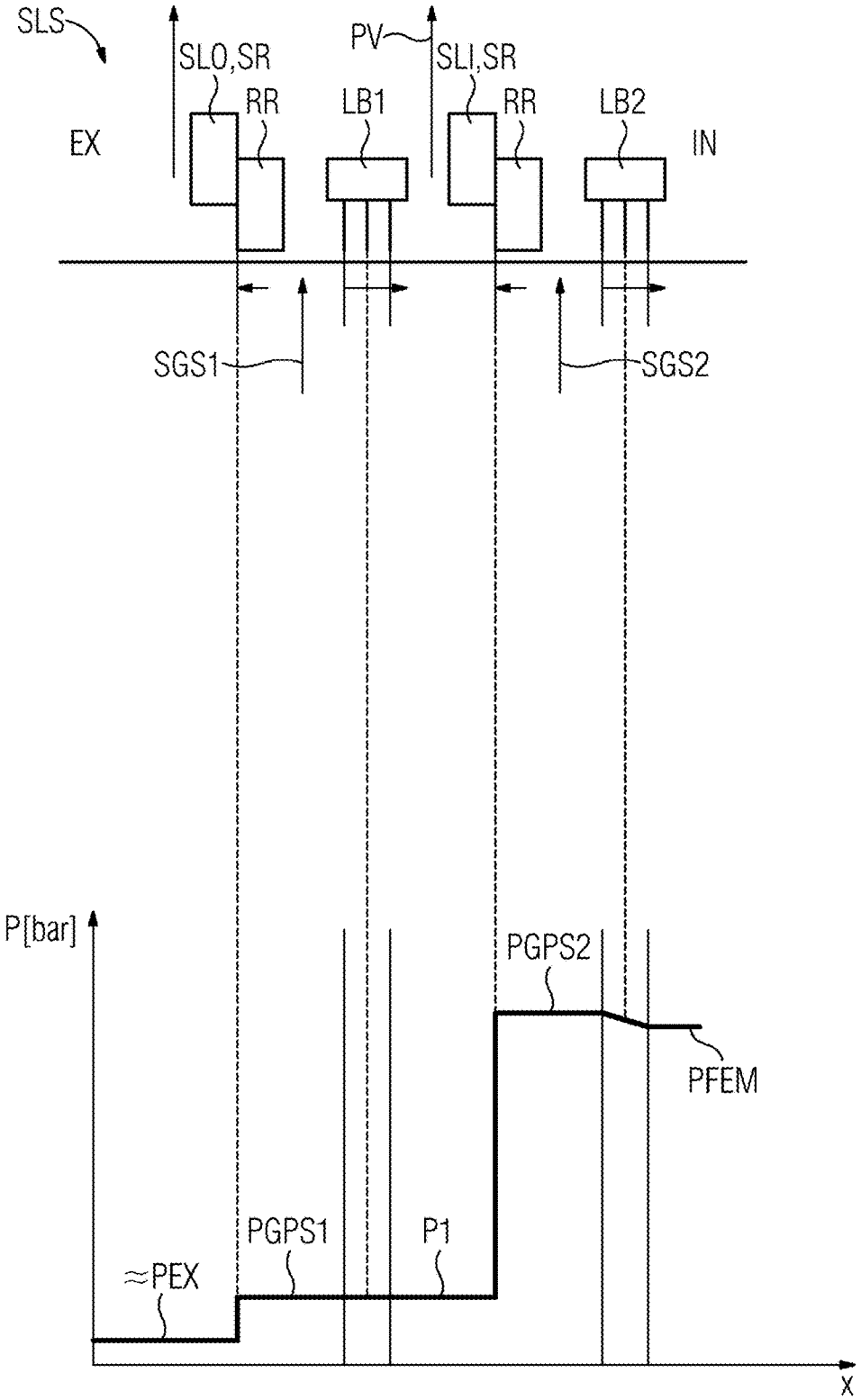
FIG. 2 shows the axial pressure variation across the seal, which is shown in FIG. 1 on the left-hand side of the turbocompressor.

FIG. 2 shows schematically the pressure variation across a shaft seal SLS of the fluid energy machine FEM. Here, FIG. 2 shows the pressure variation in respect of the left-hand shaft seal SLS in FIG. 1.

The fluid energy machine FEM according to the invention shown in FIG. 1 is designed as a turbocompressor TC, wherein the turbocompressor TC has a rotor R and an impeller IMP and a casing C. A gap GP is formed on each of two sides between the rotor R and the casing C in a region in which the rotor R passes from an interior IN of the casing C into an exterior EX outside the casing C. To seal this gap, the fluid energy machine FEM provides a shaft seal SLS, which is designed as a tandem dry gas seal TDGS. In sequence from the interior IN to the exterior EX, the following modules are provided in the tandem dry gas seal TDGS: a second labyrinth seal LB2, an inner seal SLI, a first labyrinth seal LB1 and an outer seal SLO. The inner seal SLI and the outer seal SLO are each designed as dry gas seals, each comprising a rotating ring RR and a stationary ring SR. The rotating ring RR is part of the rotor R and the stationary ring SR is mounted indirectly on the casing C—these shaft seals are generally parts of a cartridge for insertion through the casing into a casing aperture at the shaft leadthroughs.

The process fluid pressure PFEM provided during operation in the interior IN of the casing C of the fluid energy machine FEM is generally higher than the pressure PEX in the exterior EX. As illustrated on the right-hand side of the shaft seal SLS depicted on the right in FIG. 1—it is optionally possible to provide a third labyrinth LBEX, which, in particular, sealingly protects the outer seal SLO from the environment. Situated on both sides, axially between the second labyrinth LB2 and the inner seal FLI, there is a second sealing gas feed SGS2 with the pressure PSGS2, which opens into the gap GP. Provided axially between the first labyrinth LB1 and the inner seal SLI is a primary discharge PV, by means of which the pressure in the gap between the first labyrinth LB1 and the inner seal SLI is adjusted to a first pressure P1 or a first setpoint pressure P1SET. A first sealing gas feed SGS1 is provided axially between the first labyrinth LB1 and the outer seal SLO and feeds sealing gas at a pressure PSGS1 into the gap GP when required. The pressure PSGS2 of the second sealing gas feed SGS2 is determined by the supply pressure PSGS of a sealing gas system SGS. This sealing gas system SGS supplies dry and clean sealing gas of the desired chemical composition at the pressure PSGS to the second sealing gas feed SGS2. The first sealing gas feed SGS1 is connected to the second sealing gas feed SGS2 by means of a controllable control member V1, thus allowing a pressure PSGS1 in the sealing gas feed to be set by means of the control member V1. Here, the control member V1 is a controllable valve with corresponding control system and drive. Before the sealing gas enters the gap GP between the first labyrinth LB1 and the outer seal SLO by means of the first sealing gas feed SGS1, it first of all passes through a manual valve VM and a first restrictor element TH1. In the context of commissioning, the manual valve VM enables the inflow of sealing gas to be interrupted and this region to be isolated. The first restrictor element TH1 prevents an excessive sealing gas feed in the event of a malfunction in the first control member. In this way, a first gap pressure PGPS1 is established between the first labyrinth LB1 and the outer seal SLO. The pressure PSGS is likewise lowered in the second sealing gas feed SGS2 by means of a second restrictor element TH2 before the sealing gas enters the gap GP between the second labyrinth LB2 and the inner seal SLI.

The primary discharge PV opening into the gap GP between the first labyrinth LB1 and the inner seal SLI, for discharging a primary discharge fluid PVF, is adjusted to a pressure PPV by means of a controllable second control member V2. In this case, the second control member can be designed as a controllable valve, in a manner essentially similar to the first control member. A third restrictor element TH3 is situated in the line of this primary discharge PV, resulting in a pressure P1 in the gap GP upstream of the third restrictor element TH3 on the basis of the discharge flow direction.

A control unit CU is connected to the first control member V1, the second control member V2 and a pressure measuring point PIT, which measures the pressure P1 in the gap GP indirectly via the primary discharge PV. The control unit CU sets the open positions of the first control member V1 and the second valve V2 in such a way that the pressure P1 corresponds to the first setpoint pressure P1SET in the gap GP axially between the inner seal SLI and the first labyrinth LB1. Here, the control unit CU is designed in such a way that the first pressure P1 is adjusted to the first pressure P1SET by a procedure in which, in a first step, the open position of the second valve V2 is first of all controlled and the first valve V1 is closed and, in a second step, with the first valve closed and a first pressure P1 lower than the first setpoint pressure P1SET, the second valve V2 is opened and, in a third step, with the second valve V2 closed, the open position of the second valve V2 is controlled until the first pressure P1 corresponds to the first setpoint pressure P1SET and, with the first valve closed, the first step is initiated again.

The result of this pressure control in the shaft seal SLS is represented in FIG. 2. FIG. 2 shows how, starting from a process fluid pressure PFEM in the interior IN, the pressure in the second labyrinth LB2 rises owing to a second gap pressure PGPS2 from the second sealing gas feed SGS2 and, with the progressive approach to the exterior EX, falls sharply to the first pressure P1 in the region of the inner seal SLI owing to the high differential pressure across the inner seal SLI and the primary discharge PV.

According to an advantageous development of the invention, the higher differential Pressure—compared with the outer seal SLO—is always present across the inner seal during operation.

A further slight pressure drop occurs across a first labyrinth LB1 to a first gap pressure PGPS1, which falls to ambient pressure PEX in the outer seal SLO as the gas approaches the exterior EX.

An advantageous development envisages that the control unit issues an alarm if the first pressure falls below an alarm pressure PAL.

It is furthermore expedient if the control unit brings about shutdown of the fluid energy machine if the first pressure falls below a shutdown pressure.

The invention claimed is:

1. A fluid energy machine, comprising:
a rotor extending along an axis,
a casing, wherein the casing separates an interior from an exterior,
at least one shaft seal for sealing a gap between the rotor and the casing,
wherein the shaft seal is designed as a tandem dry gas seal,
wherein the tandem dry gas seal comprises an inner seal and an outer seal,
wherein the outer seal has a first sealing gas feed, which opens into the gap axially between the outer seal and the inner seal,
wherein the shaft seal has a primary discharge between the inner seal and the outer seal, which discharges a primary discharge fluid from the gap,
wherein the first sealing gas feed has a first control member for controlling the flow rate of the sealing gas out of a sealing gas system,
wherein the primary discharge has a second control member for controlling the flow rate of a primary discharge fluid,
wherein the first control member and the second control member are matched to one another in such a way that a first pressure is adjusted to a first setpoint pressure by a procedure in which,
in a first step, the open position of the second control member is first of all controlled to adjust the first pressure and the first control member is closed, and,
in a second step, if the first pressure remains lower than the first setpoint pressure with the second control member closed, the first control member is opened while the second control member is closed, and the open position of the first control member is controlled to adjust the first pressure until the first pressure has been adjusted to the first setpoint pressure, and,
in a third step, if the first pressure remains higher than the first setpoint pressure with the first control member closed, the first step is initiated again.

2. The fluid energy machine as claimed in claim 1,
wherein the shaft seal has a pressure measuring point between the inner seal and the outer seal or in the primary discharge, which measures a first pressure indirectly or directly in the gap.

3. The fluid energy machine as claimed in claim 2, further comprising:
wherein a control unit which is connected to the pressure measuring point, the first control member and the second control member,
wherein the control unit is designed in such a way that the first pressure is adjusted to the first setpoint pressure by a procedure in which,
in a first step, the open position of the second control member is first of all controlled to adjust the first pressure and the first control member is closed, and, in a second step, if the first pressure remains lower than the first setpoint pressure with the second control member closed, the first control member is opened while the second control member is closed, and the open position of the first control member is controlled to adjust the first pressure until the first pressure has been adjusted to the first setpoint pressure, and, in a third step, if the first pressure remains higher than the first setpoint pressure with the first control member closed, the first step is initiated again.

4. The fluid energy machine as claimed in claim 1, wherein the control of the control members is accomplished by means of pressure setpoints that can be set directly at the control members.

5. The fluid energy machine as claimed in claim 1, wherein a higher pressure setpoint is set at the second control member than at the first control member.

6. The fluid energy machine as claimed in claim 1, wherein, toward the interior, a first labyrinth seal for sealing the gap is assigned to and adjacent to the outer seal.

7. The fluid energy machine as claimed in claim 6, wherein the first sealing gas feed opens into the gap axially between the outer seal and the first labyrinth seal.

8. The fluid energy machine as claimed in claim 6 or 7, wherein the primary discharge opens into the gap axially between the first labyrinth seal and the inner seal.

9. The fluid energy machine as claimed in claim 3, wherein the control unit issues an alarm if the first pressure falls below an alarm pressure.

10. The fluid energy machine as claimed in claim 3, wherein the control unit brings about shutdown of the fluid energy machine if the first pressure falls below a shutdown pressure.

11. The fluid energy machine as claimed in claim 1, wherein, toward the interior, a second labyrinth seal for sealing the gap is assigned to and adjacent to the inner seal.

12. The fluid energy machine as claimed in claim 1, wherein the inner seal has a second sealing gas feed, which opens into the gap axially toward the interior, adjacent to the inner seal.

13. The fluid energy machine as claimed in claim 12, wherein the second sealing gas feed opens into the gap axially between the inner seal and the second labyrinth seal.

14. The fluid energy machine as claimed in claim 12, wherein the first sealing gas feed is connected to the second sealing gas feed in such a way that changing the pressure of the sealing gas from the sealing gas system also brings about a change in the pressure of the first sealing gas feed.

15. The fluid energy machine as claimed in claim 12, wherein the first sealing gas feed and/or the second sealing gas feed each have a restrictor element, by means of which the flow of the sealing gas flowing into the gap can be limited to a maximum flow.

16. A method for operating a fluid energy machine, wherein the fluid energy machine comprises a rotor extending along an axis, a casing, wherein the casing separates an interior from an exterior, at least one shaft seal for sealing a gap between the rotor and the casing, wherein the shaft seal is designed as a tandem dry gas seal, wherein the tandem dry gas seal comprises an inner seal) and an outer seal, wherein the outer seal has a first sealing gas feed, which opens into the gap axially between the outer seal and the inner seal, wherein the shaft seal has a primary discharge between the inner seal and the outer seal, which discharges a primary discharge fluid from the gap, wherein the first sealing gas feed has a first control member for controlling the flow rate of the sealing gas out of a sealing gas system, wherein the primary discharge has a second control member for controlling the flow rate of a primary discharge fluid, the method comprising:

adjusting a first pressure to a first setpoint pressure by a procedure in which, in a first step, the open position of the second control member is first of all controlled to adjust the first pressure and the first control member is closed, and, in a second step, if the first pressure remains lower than the first setpoint pressure with the second control member closed, the first control member is opened while the second control member is closed, and the open position of the first control member is controlled to adjust the first pressure until the first pressure has been adjusted to the first setpoint pressure, and, in a third step, if the first pressure remains higher than the first setpoint pressure with the first control member closed, the first step is initiated again.

17. The method for operating a fluid energy machine as claimed in claim 16, wherein the shaft seal has a pressure measuring point between the inner seal and the outer seal or in the primary discharge, which measures a first pressure indirectly or directly in the gap, wherein a control unit is connected to the pressure measuring point, the first control member and the second control member.

18. The method for operating a fluid energy machine as claimed in claim 16, wherein the control of the control members is accomplished by means of pressure setpoints that can be set directly at the control members.

19. The method for operating a fluid energy machine as claimed in claim 18, wherein a higher pressure setpoint is set at the second control member than at the first control member.

20. The fluid energy machine as claimed in claim 1, wherein the fluid energy machine comprises a turbocompressor.

* * * * *